US007237396B1

(12) United States Patent
Nichol

(10) Patent No.: US 7,237,396 B1
(45) Date of Patent: Jul. 3, 2007

(54) ICE LIGHTING DEVICE

(75) Inventor: Anthony J. Nichol, Woodbury, MN (US)

(73) Assignee: BriteIce Technologies LLC, Chicago, IL (US)

( * ) Notice: Subject to any disclaimer, the term of this patent is extended or adjusted under 35 U.S.C. 154(b) by 97 days.

(21) Appl. No.: 11/082,336

(22) Filed: Mar. 17, 2005

Related U.S. Application Data

(60) Provisional application No. 60/555,119, filed on Mar. 22, 2004.

(51) Int. Cl.
*A63C 19/10* (2006.01)

(52) U.S. Cl. ..... 62/235; 62/56; 62/260; 315/32

(58) Field of Classification Search ..... 315/32; 62/235, 264, 56, 260; 40/546
See application file for complete search history.

(56) References Cited

U.S. PATENT DOCUMENTS

| | | | | |
|---|---|---|---|---|
| 662,514 | A | 11/1900 | Yocum | |
| 2,732,688 | A | 1/1956 | Dickson | |
| 4,467,481 | A * | 8/1984 | Ginsburg | 4/240 |
| 4,551,985 | A * | 11/1985 | Kovach | 62/235 |
| 4,667,481 | A | 5/1987 | Watanabe et al. | |
| 5,134,857 | A * | 8/1992 | Burley | 62/235 |
| 5,315,673 | A * | 5/1994 | Stetter et al. | 385/12 |
| 5,379,539 | A | 1/1995 | Hannula | |
| 5,737,472 | A | 4/1998 | Bernasson et al. | |
| 5,938,991 | A | 8/1999 | Pollock | |
| RE37,186 | E * | 5/2001 | Hill | 428/187 |
| 6,315,433 | B1 | 11/2001 | Cavello | |
| 2004/0093779 | A1 * | 5/2004 | Blach | 40/546 |

FOREIGN PATENT DOCUMENTS

| | | | |
|---|---|---|---|
| CN | 1206661 | | 2/1999 |
| GB | 198085 | | 5/1923 |
| JP | 2000141997 | A * | 5/2000 |
| JP | 2001-243818 | | 9/2001 |
| JP | 2001243818 | A * | 9/2001 |

* cited by examiner

*Primary Examiner*—Tho Phan
*Assistant Examiner*—Chuc Tran
(74) *Attorney, Agent, or Firm*—Craig A. Fieschko, Esq.; DeWitt Ross & Stevens S.C.

(57) ABSTRACT

A lighting device for illuminating ice has a sheet of light-transmitting film located below an ice layer and coupled to a light source. The index of refraction of the light-transmitting film is greater than that of the adjoining ice or air so that the light within the film experiences substantial internal reflection. Light is emitted from the film (and the ice surface) at emission regions that disrupt internal reflection.

17 Claims, 1 Drawing Sheet

ICE LIGHTING DEVICE

CROSS-REFERENCE TO RELATED APPLICATION

This application claims priority under 35 USC § 119(e) to U.S. Provisional Patent Application 60/555,119 filed 22 Mar. 2004, the entirety of which is incorporated by reference herein.

FIELD OF THE INVENTION

This document concerns an invention relating generally to lighting devices, and more specifically to devices for illuminating ice.

BACKGROUND OF THE INVENTION

Many arenas and stadiums which accommodate hockey, ice skating, and other ice sports have methods of visual entertainment for the attendees, including flashing scoreboards, traveling spotlights (for highlighting sports players or entertainers), laser light displays, and so forth. These lights provide visual stimuli and information, which increases general attendee excitement and crowd attendance. Some light sources are visible with the arena lights on or off, while others can only be viewed at low lighting. For example, images are sometimes projected onto floors or ceilings, but the images are usually difficult to see unless at least some of the lights are dimmed or turned off.

Some prior patent documents have illustrated the use of illuminators which emit light from the ice itself. One example is illustrated in U.S. Pat. No. 4,667,481, which utilizes a light-emitting diode (LED) panel embedded within the ice. However, this device is not known to be in widespread use, probably owing to its cost, thermal issues (i.e., heat from the LEDs melting the ice), size, difficulty in installation and removal, and its visibility within the ice when it is not illuminated. Japanese Patent Document JP2001243818 illustrates the use of fiberoptic cables embedded in ice to generate illuminated lines and linear characters (e.g., cursive letters) in a manner somewhat similar to neon lighting. However, this arrangement is also not known to be widely used, probably owing to high cost, the large fiber diameter needed to generate noticeable illumination (which in turn causes difficulties with cable stiffness and bending), the difficulty in forming cables into desired shapes (and retaining them in such shapes while ice is formed atop them), and related difficulties with installation and removal.

To better understand the drawbacks of the foregoing systems, it is useful to review the conventional arrangement used to form an ice rink. The ice rink is usually situated atop a chilled concrete slab, which usually has embedded pipes or channels for circulating some chilling medium at below-freezing temperatures (often brine at approximately 16 degrees F.). Atop the slab, a dam, which is generally formed of aluminum or steel, encircles the rink area wherein the ice is to be formed. This dam retains water in the rink area while it is chilled to form ice. Ice is usually formed by spraying deionized water in a fine mist atop the rink area of the slab, and it is usually formed in layers, with a new layer being sprayed on once the prior one freezes. Often, one or more of the initial layers of ice is painted to form a more regularly-colored playing surface, and/or to define game indicia (border lines, goal lines, foul lines, etc.) or decorations (logos, ads, etc.). Usually, the second layer of ice is completely painted white, the third layer is applied atop it and then the game indicia and/or decorations are painted on this third layer, and then subsequent ice layers are then formed atop these prior layers until all layers are approximately 1.5 inches thick (or some other thickness such that the surface temperature can be maintained at about 2 degrees F., which is usually optimal for skating). Dasher boards, tall barriers which effectively fence off the rink area, are then often situated on and bolted to the dam bounding the rink area. The whole process for constructing the rink can take 6–48 hours.

Since most ice rinks are used for other purposes besides hockey or ice shows, the rinks often need to be converted to other uses in a short period of time (e.g., for basketball, concerts, etc.). Often, the ice rinks are converted to other uses by simply removing the dasher boards and placing new flooring over the rink area and dam, with the ice being preserved beneath for reuse. However, other uses may require hasty disassembly of the ice so that the slab of the rink can itself be used as a floor surface, in which case the ice is simply broken or cut for removal.

Because of the steps needed for the foregoing assembly process and the nature of the constructed rink, LED arrays and fiberoptic cables are not very suitable: their size and dimensions make it difficult to form the rink in the conventional manner without having "bumps" in the ice, and one cannot simply disassemble the rink by breaking the ice without also risking breakage of the (relatively expensive) LED arrays and fiberoptic cables. It would therefore be useful to have some form of ice illumination system available for use which at least partially overcomes some of the problems of the prior systems.

SUMMARY OF THE INVENTION

The invention involves an ice illumination system which is intended to at least partially solve the aforementioned problems. To give the reader a basic understanding of some of the advantageous features of the invention, following is a brief summary of a preferred version of the illumination system. As this is merely a summary, it should be understood that more details regarding the preferred versions may be found in the Detailed Description set forth elsewhere in this document. The claims set forth at the end of this document then define the various versions of the invention in which exclusive rights are secured.

A preferred version of the invention, as depicted in the accompanying FIG. 1, involves a lighting device 100 for use within ice which includes an at least partially translucent film 112 capable of transmitting light through its interior. The film 112 is situated in a horizontal plane below a layer of ice 106 in an ice rink or other ice surface, and has a light source 116 optically coupled to the film 112 to transmit light through the film 112, beneath the ice layer 106, and then out of the surface of the film 112 and through the ice layer 106 to be viewed by observers. Because the light source 116 is not imbedded in the ice 106, the ice surface is not disrupted.

The film 112, which is preferably provided in flexible/foldable sheet form for ease of handling and installation, has opposing film surfaces (preferably having a large area) bounded by a thin film edge. The film 112 has a refractive index greater than ice (which has an index of refraction of about 1.3) such that when the film surfaces are bounded by ice, they are at least partially internally reflective. Thus, light entering the film 112 at a high angle of incidence (i.e., at a high angle off of the perpendicular to the opposing film surfaces)—as by inputting light at the film edge—will tend to internally reflect within the film 112. Emission regions, i.e., regions which disrupt internal reflection and thereby promote emission through a film surface, are then provided at desired portions of the film surfaces (e.g., to define logos, messages, or other indicia) so that these emission regions will effectively be illuminated when light is transmitted through the film 112. Such emission regions can be formed by roughening a surface (and perhaps a corresponding area of the opposing surface) of the film 112, as by scuffing or etching it (as at 118A), and/or by adding a colorant within the film 112 or upon its surface, with a preferred arrangement being to simply print or paint the emission regions onto a film surface as desired, as at 118B. Because the light transmitted into the film 112 from the light source 116 is primarily limited to escaping the film 112 at the emission regions 118A/118B (i.e., almost all of the input light is emitted from the emission regions 118A/118B), the display provided by the lighting device 100 will generally have sufficient intensity that it is visible in lighted environments, i.e., the lighting in the device's environment does not have to be dimmed for the display to be seen.

The light source 116 is then preferably coupled to the film 112 at a film edge, and it may be provided in the form of an array of LEDs extending across the film edge, a laser scanning the film edge, or in other forms. Standard incandescent lights can be used if their light is concentrated across the film edge, as by receiving their light within the input ends of fiberoptic cables, and then situating the output ends of the cables in an array across the film edge. Particularly preferred illuminators are LED chips, that is, the chips/driving circuits used to form standard LEDs, but lacking the plastic encapsulation that defines the outer surface of conventional LEDs. The light source 116 may be provided within or adjacent to the dam 104 conventionally used to bound the rink, or it could instead be situated elsewhere (e.g., within the dasher boards 114 or outside the dam 104) if the light is piped to the film edge within the dam 104, or if the film 112 extends outside the perimeter of the dam 104.

The film 112 is preferably provided as a sheet of inexpensive (and effectively disposable) flexible plastic film, with polycarbonate and acrylic (e.g., polymethyl methacrylate) films having thicknesses of less than 0.75 mm being particularly preferred. Since such films effectively serve as insulators, it is particularly preferred that the film 112 have a thickness of less than 0.5 mm to reduce the possibility that the film 112 might thermally interfere with ice formation and maintenance. The film 112 is preferably coupled to the light source 116 by a clamping arrangement wherein a pair of opposing clamps 110 have the light source 116 situated along the plane toward which the clamps 110 are urged when they close, such that when the clamps 110 sandwich the film 112, the film edge is automatically situated next to the light source 116. The clamping arrangement allows for the easy installation of new film 112 (and its coupling to the light source 116), and if desired the film 112 can simply be removed and discarded with old ice, and can be replaced with new film when a new rink is installed.

The film 112 of the device 100 is effectively invisible within the ice surface when the light source 116 is inactive, with the emission regions 118A/118B becoming visible once the light source 116 is activated, and without any need to dim the ambient lights. As a result, team logos, advertisements, game announcements (e.g., "GOAL!"), and/or other indicia may be displayed when desired by simply activating the light source for a desired section of film 112. Since multiple pieces of film 112 and/or multiple light sources 116 may be installed, different messages may be displayed at different areas of the ice 106 at the same or different times.

Further advantages, features, and objects of the invention will be apparent from the following detailed description of the invention in conjunction with the associated drawings.

DETAILED DESCRIPTION OF PREFERRED VERSIONS OF THE INVENTION

Figure 1:
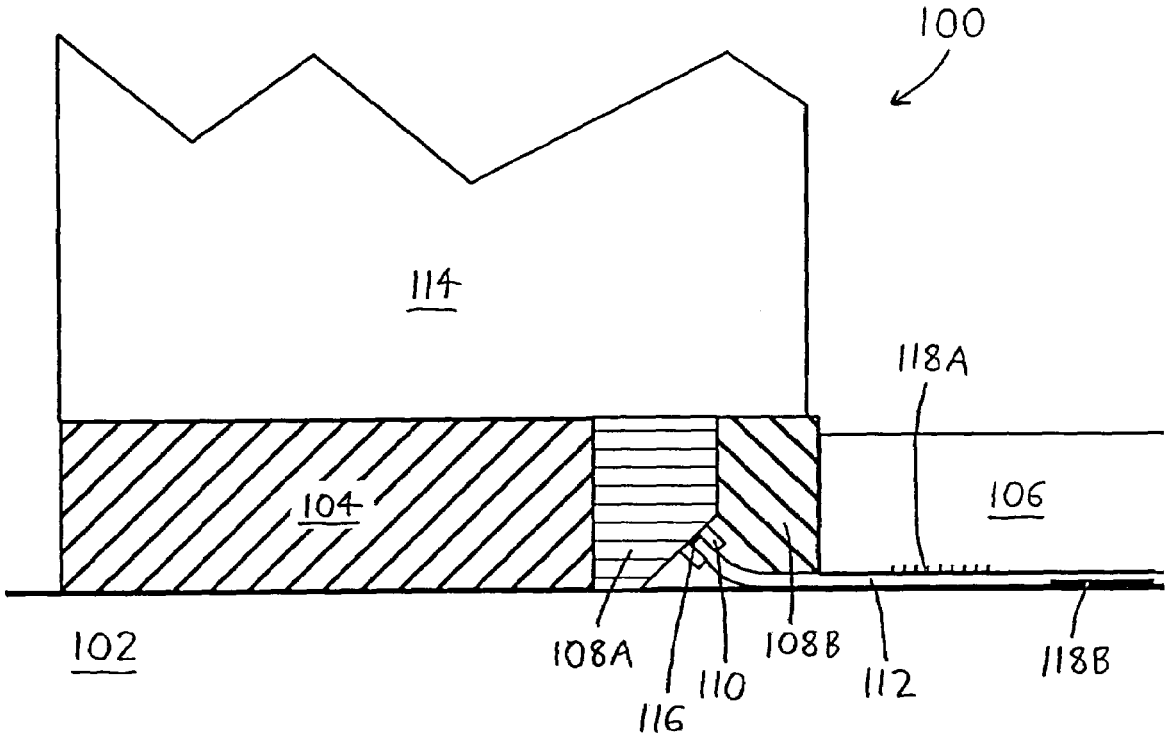
FIG. 1 illustrates a side elevational view of a section of a first exemplary version of the lighting device 100, wherein a sheet of ice 106 is formed above a sheet of light-transmitting film 112, with the film 112 being retained within a clamp 110 to receive light from a light source 116 and to subsequently emit the light from emission regions 118A (formed by film surface discontinuities) and/or 118B (formed by paint or other colorant on a film surface).

Looking to FIG. 1, a first exemplary version of the invention is depicted generally by the reference numeral 100. The lighting device 100 is depicted within a typical rink defined by a chilled concrete slab 102, and a dam 104 which rises above the slab 102 to encircle the periphery of a sheet of ice 106. A film mount is then provided in two parts, an inner part 108A and an outer part 108B, between the ice 106 and the inner surface of the dam 104. The inner film mount 108A has a clamp 110 situated thereon to grasp and retain a sheet of light-transmitting film 112, which extends beneath the outer film mount 108B to travel below the ice 106 (which is formed atop the film 112). A dasher board 114 is also provided atop the dam 104 and the film mount 108A/108B.

A light source 116 is situated between the opposing parts of the clamp 110 to emit light into the edge of the film 112. The light travels within the interior of the film 112, and so long as the light travels substantially along the plane of the film 112, and so long as the index of refraction of the film 112 is greater than that of any adjoining air or ice (with the index of refraction of air being 1.0, and that of ice being approximately 1.3), the light within the film 112 should experience substantial internal reflection within the film 112. The light will therefore not be emitted through the surface of the film 112 until it encounters some emission region that causes it to scatter or internally reflect at an angle less than its critical angle, at which point the light may emit through the surface of the film 112.

Two types of emission regions for disrupting internal reflection are shown in FIG. 1. First, an emission region 118A is formed on the top surface of the film 112 adjacent the ice 106, wherein the emission region 118A is formed by scuffing or otherwise roughening the surface of the film 112. Second, an emission region 118B is formed by a patch of colorant (e.g., paint) on the bottom surface of the film 112 (or such colorant may instead be provided within the film 112 itself, if desired). Other types of emission regions, formed on either or both surfaces of the film 112 or within its interior, are possible. One example which is not depicted in the drawings is to simply define a pattern of small holes or apertures in the film 112. Apart from interrupting internal reflection of light and allowing light emission from the surface of the film 112, such apertures also usefully allow the release of air bubbles from beneath the film 112 when spraying water to form the ice 106, and such apertures also help to form a firm bond between the film 112 and the ice 106. The emission regions 118A, 118B may take the form of words, logos, or any other indicia capable of being printed or otherwise applied to the film 112. Additionally, the emission regions 118A/118B can be functionally graded, i.e., their density can increase with their distance from the light source 116, so that areas of the emission regions 118 which are more distant from the light source 116 will emit with intensity at least substantially equal to that at regions closer to the light source 116.

The light source 116 is preferably formed of an array of LED chips (as previously discussed), though other illuminators are possible. Arrayed illuminators are preferably densely packed so that a large amount of light can be supplied to the edge of the film 112; for example, prototypes of the lighting device 100 have used 300 LED chips per each foot of the edge of the film 112. Because the light source 116 may generate sufficient heat to cause softening of any adjacent ice 106, the inner film mount 108A is preferably formed of a highly heat-conductive material (such as metal) which allows transmission of heat to the dam 104. In contrast, the outer film mount 108B is preferably formed of an insulating material, thereby forming a heat-resistant barrier between the ice 106 and the light source 116. Beneficially, LED chips (or complete LEDs) have greater efficiency and light output when cooled, and thus it may be found that the lighting device 100 will have unexpectedly strong illumination once installed.

A wide variety of plastic films are suitable for use as the film 112, since most have refractive indices greater than those of ice. PC (polycarbonate) and PMMA (polymethyl methacrylic) films are particularly preferred owing to their cost, ease of handling and printability, and insulating properties. Since these films are good insulators, they will not transmit significant heat to the ice 106. In this respect, it is notable that the film 112 preferably has a thickness of less than 0.75 millimeters, and most preferably less than 0.5 millimeters, so that it will not unduly interfere with heat transfer between the ice 106 and the chilling slab 102 beneath the film 112. Apart from thermal issues, thicker films 112 can also effectively weaken overlaid sheets of ice 106 and promote cracking, whereas thinner films 112 generally do not impart any significant weakness to the ice 106. For this reason, it is also preferred that the film 112 be provided closer to the chilled slab 102 than the top surface of the ice 106 (though it should be understood that the film 112 need not abut the slab 102 as shown in the version of the invention depicted in FIG. 1, and one or more layers of ice 106 could be situated between the slab 102 and the film 112).

In use, the film 112 is effectively invisible in the ice 106 when the light source 116 is off. When the light source 116 is activated, light is transmitted through the film 112 and illumination occurs where the internal reflections of light are disrupted, i.e., at the emission regions 118A and 118B. To help reduce emissive losses of light from the film 112 at undesired areas (i.e., at areas other than the emission regions 118), the edges of the film 112 away from those coupled to the light source 116 can be painted or otherwise coated with a reflective coating. This can also be done to the lower surface of the film 112, though such a step is generally not necessary. Some illumination can occur from the film 112 at unwanted areas if the film 112 is scuffed, marked, or otherwise blemished during installation, but this effect is reduced with careful installation, and if desired, can be further reduced by simply painting one or more ice layers formed above the film 112, save for at areas which rest over any emission regions 118. In this manner, the film 112 is effectively masked, save for its emission regions 112.

It should be understood that the film 112 may extend outwardly from the light source 116 as far as desired, and it could potentially extend across the entire area of the ice rink (which might have some or all of its perimeter provided with light sources 116 for illumination of the film 112). However, for ease of installation, handling, and replacement, it is preferred that the film 112 be provided in sheets of perhaps 1–10 meters long (extending outwardly from the dam 104), and perhaps 2 meters wide, so that each sheet may be separately rolled out from a section of the dam 104 and installed and controlled independently of other adjacent films 112. Thus, multiple pieces of film 112 can be installed at different regions of the rink, and these can be illuminated individually or in combination, and/or to provide special effects (e.g., sequentially-lit "running displays," etc.).

The clamp 110 can be easily and inexpensively formed of adjacently-situated flexible flanges (e.g., made of elastomers such as rubber) which sandwich the light source 116, and which may be easily spread apart by hand to insert the edge of the film 112. If the light source 116 is formed by a linear array of LED chips (which are generally dimensioned as cubes having dimensions of about 0.2 mm per side), the light source 116 will form a sufficiently narrow gap between the halves of the clamp 110 that the film 112 can easily be retained therein. If other light sources are used, e.g., incandescent light sources or whole LEDs (with a plastic capsule surrounding each LED chip), such light sources may be too thick/large to simply situate them between a pair of opposing halves/jaws of the clamp 110. Thus, these might be (for example) situated within one or more cavities in the inner film mount 108A, with the cavities having reflective inner surfaces to minimize light loss, and with the cavities having narrow emitting slits situated between the halves/jaws of the clamp 110. If desired, optical gel or other materials which enhance light transmission between the light source 116 and the edge of the film 112 may be situated within the clamp 110 prior to insertion of the film 112. Additionally, the inner surfaces of the clamp 110 which bear against the opposing surfaces of the film 112 may be vacuum-coated with silver or gold or otherwise coated with reflective materials to diminish light loss between the light source 116 and the edge of the film 112.

If the ice 106 must be removed, the lighting device 100 may be easily removed as well. The film 112 is sufficiently inexpensive that it can effectively be treated as disposable, and thus it can be broken out and discarded with any ice 106. Alternatively, if the ice 106 is left to melt, the film 112 can then be rolled or folded for later reuse.

It should be understood that a basic preferred version of the invention was shown and described above, and modified versions of the lighting device 100 are also considered to be within the scope of the invention. Following is an exemplary list of such modifications.

First, the components of the lighting device 100 may be arranged differently than as shown in FIG. 1, and may have vastly different configurations. For example, the light source 116 can take forms other than LED chips and/or LEDs, e.g., as an incandescent lamp (preferably a halogen or metal halide lamp for greater light intensity), or as a laser which rapidly scans along the edge of the film 112. If the heat of the light source 116 is desirably kept more distant from the ice 106, the film 112 can simply extend beyond the surface of the ice 106, and/or light can be piped to the edge of the film 112 via an array of fiberoptic cables. To illustrate, the light source 116 and coupling system 110 may be located outside of the dam 104 on the floor surrounding the rink, and the film 112 may pass under the dam 104 and into the ice 106. (If the dam 104 is secured to the floor with bolts, holes may be made in the film 112 to accommodate these bolts.) Alternatively, the light source 116 could be situated in the dasher boards 114. For easier transmission of light into the film 112, the edge that receives the light can be made thicker, with the thickness tapering down as the film 112 grows more distant from the light source 116.

Second, different colors of light may be emitted at the emission regions 118A and 118B if desired. This could be done, for example, by installing differently colored filters at the light source 116, providing differently-colored light sources (e.g., providing an array of differently-colored LED chips wherein the chips alternate in colors, and the different colors can be independently activated), providing emission regions 118A and 118B which emit at different wavelengths (e.g., providing colorant 118B which emits at a different color than the received light), and so forth. Images with multiple colors may be displayed by stacking layers of film 112, perhaps with layers of ice 106 therebetween, and with each having its own light source 116 and emission regions 118A/118B. In this case, the emission regions of each layer of film 112 are preferably non-overlapping so that an emission region in a lower layer does not cause illumination of an emission region in a layer above, though with careful arrangement of the colors of the light sources 116, the emission regions 108A/108B, and the refractive indices of the films 112, overlapping emission regions 108A/108B might be arranged to provide unique effects.

The invention is not intended to be limited to the preferred versions described above, but rather is intended to be limited only by the claims set out below. Thus, the invention encompasses all different versions that fall literally or equivalently within the scope of these claims.

What is claimed is:

1. A lighting device for use within ice, the device including:

a. an at least partially translucent film capable of transmitting light through its interior, wherein the film has:

(1) opposing film surfaces bounded by a film edge, the film surfaces being at least partially internally reflective when situated adjacent ice, and (2) at least a portion of one of the film surfaces bears an emission region, the emission region disrupting internal light reflection within the film and causing light emission from at least one of the film surfaces, wherein the film is sitnated below a layer of ice; and b. a light source optically coupled to the film edge.

2. The light device of claim 1 wherein the film has:

a. a thickness of less than 0.75 mm, and b. a refractive index greater than that of ice.

3. The lighting device of claim 1 wherein the film has a thickness of less than 0.5 mm.

4. The lighting device of claim 1 wherein the film is foldable.

5. The light device of claim 1 wherein the ice defines a skating rink.

6. The lighting device of claim 1 wherein:

a. the film is received between a pair of opposing clamps, each clamp bearing against one of the opposing film surfaces; and b. the light source is situated between the clamps.

7. The lighting device of claim 1 wherein the emission region is defined by colorant situated on the film surface.

8. The lighting device of claim 1 wherein the emission region is defied by surface roughening situated on the film surface.

9. A lighting device for use within ice, the device including:

a. an at least partially translucent foldable film having opposing film surfaces bounded by a film edge, the film bearing an emission region wherein light transmitted through the interior of the film has greater emission from at least one of the film surfaces at the emission region than at other adjacent regions wherein the film is situated below a layer of ice; and b. a light source optically coupled to the film edge.

10. The lighting device of claim 9 wherein the ice defies a skating rink.

11. The lighting device of claim 9 wherein the film has a thickness of less than 0.75 mm.

12. The lighting device of claim 9 wherein the film has a thickness of less than 0.5 mm.

13. The lighting device of claim 9 wherein the emission region is defined by colorant situated on the film surface.

14. The lighting device of claim 9 wherein the emission region is defined by surface roughening situated on the film surface.

15. A lighting device for use within ice, the device including:

a. a raised dam encircling a rink area, the dam being adapted to retain water in the rink area as it is frozen to provide a skating surface;

b. an at least partially translucent film having opposing film surfaces bounded by a film edge, the film being extended at least substantially horizontally across at least a portion of the rink area wherein the film is beneath a layer of ice situated in the rink area; and c. a light source optically coupled to the film edge to emit light into the film.

16. The lighting device of claim 15 wherein the film:

a. has a thickness of less than about 0.5 mm, and b. has an index of refraction greater than 1.3.

17. The lighting device of claim 15 wherein the film bears one or more emission regions defined thereon, each emission region causing greater light emission from the interior of the film and though at least one of the film surface than at adjacent regions, and wherein each emission region is defined by at least one of:

a. colorant, and b. surface roughening, on the film surface.

* * * * *